US005318210A

United States Patent [19]

Morand

[11] Patent Number: 5,318,210

[45] Date of Patent: Jun. 7, 1994

[54] PAPER TOWEL DISPENSER (SWING BOTTOM)

[75] Inventor: Michel Morand, Montreal, Canada

[73] Assignee: Wyant & Company Limited, Lachine, Canada

[21] Appl. No.: 917,946

[22] Filed: Jul. 24, 1992

[30] Foreign Application Priority Data

Jun. 26, 1992 [GB] United Kingdom ..... 9213595

[51] Int. Cl.[5] ..... B26F 3/02

[52] U.S. Cl. ..... 225/43; 225/52; 225/53; 225/85; 225/90

[58] Field of Search ..... 225/39, 43, 44, 51, 225/52, 53, 82, 84, 85, 90

[56] References Cited

U.S. PATENT DOCUMENTS

| | | | |
|---|---|---|---|
| 1,953,349 | 4/1934 | Jarvis | 225/53 X |
| 2,177,430 | 10/1939 | Greiser | 225/53 X |
| 2,232,968 | 2/1941 | Price et al. | 225/39 X |
| 2,304,312 | 12/1942 | Meglitz | 225/52 X |
| 2,589,587 | 3/1952 | Weaklend et al. | 225/85 X |
| 2,668,022 | 2/1954 | Fairfield | 225/52 X |
| 2,943,777 | 7/1960 | Dvoracek | 225/43 X |
| 3,190,520 | 6/1965 | Wyant | 225/39 |
| 3,494,518 | 2/1970 | Goss | 225/43 X |
| 3,603,519 | 9/1971 | Brown et al. | 242/55.3 |

*Primary Examiner*—Richard K. Seidel
*Assistant Examiner*—Raymond D. Woods
*Attorney, Agent, or Firm*—Larson and Taylor

[57] ABSTRACT

A dispenser for dispensing paper towelling from a roll. The dispenser has a casing for holding the roll. The casing has an open bottom. A bottom member is mounted on the casing. The bottom member is movable between a closed position where it substantially closes the open bottom of the casing, and defines, with the front of the casing, an outlet for the towelling; and an open position where it allows access into the casing to enable the leading edge of the paper towelling to be grasped should it end up within the casing.

13 Claims, 5 Drawing Sheets

PAPER TOWEL DISPENSER (SWING BOTTOM)

BACKGROUND OF THE INVENTION

1. Field of the Invention

This invention is directed toward an improved paper towelling dispenser for use in dispensing paper towelling off a roll mounted in the dispenser.

2. Description of the Prior Art

Paper towelling dispensers for dispensing towelling off a roll of paper are well known. These dispensers are normally designed to have a cutting edge at the towelling outlet against which the dispensed towelling is pulled to cut it off from the remainder of the roll. If the cutting off is done properly, the leading edge of the towelling still on the roll will remain accessible for the next user to grasp and pull off the roll. However sometimes the dispensed towelling is torn off the roll within the casing holding the roll, thus making the leading edge inaccessible. The dispenser must therefore be designed with means to rotate the roll and to guide the leading edge of the towelling to a position outside the casing where it is again accessible to a user. Thus the known dispensers are quite complicated in construction, and costly.

SUMMARY OF THE INVENTION

It is the purpose of the present invention to provide an improved paper towel dispenser, employing a roll, that is simple in construction and use, and thus relatively inexpensive to manufacture.

The dispenser of the present invention is constructed to allow easy access to the leading edge of the towelling no matter where it is located.

In accordance with the present invention there is provided a simple dispenser having a casing for holding a roll of paper towelling. The bottom of the casing is open. The dispenser includes a bottom member mounted on the casing. The bottom member normally closes the bottom of the casing and defines, with the casing, an outlet for the towelling. The bottom member however is also movable to a position allowing access into the casing through the bottom opening. This construction allows a user to move the bottom member to a position where he can reach inside the casing through the open bottom to grasp the leading edge of the paper towelling if it is located inside the casing, and to draw it out of the casing.

The bottom member is pivotably suspended from the casing. Its own weight can maintain it in the closed position closing the bottom of the casing. The casing itself can be made in two parts—a base part and a cover part. The cover part can be made movable to open up the casing so it can be loaded with a paper towelling roll. The dispenser, in its simplest form comprises only three parts. No roll turning means or towelling guide means are needed. The cover part can be made transparent so that a person can readily see where the leading edge of the paper towelling is, if it is inside the casing and also to determine how much paper is left on the roll.

If desired, the dispenser can be provided with resilient means for positively biasing the bottom member to its closed position. The resilient means pushes the bottom member against the casing to help hold the towelling in an accessible position, and thus minimize occurrences where the leading edge of the towelling ends up within the casing. Whenever the leading edge of the towelling does end within the casing however, the user can easily move the bottom member, against the resilient means, to an open position with one hand and withdraw the towelling with the other hand.

In normal use two hands are required to withdraw the towelling from the casing. With one hand the user must push the bottom member to release the leading edge of the towelling. With the other hand the user can then grasp the paper towelling and pull it from the casing. This gives some measure of control on the amount of paper that can be withdrawn at any one time from the dispenser and helps to reduce waste.

The invention is particularly directed toward a paper towel dispenser having a casing with a top, front, back and sides for enclosing and rotatably supporting a roll of paper towelling between the sides of the casing. The casing has an open bottom providing access into the casing. A bottom member is mounted on the casing. The bottom member is movable between a closed position where it substantially closes the open bottom of the casing, and cooperates with the casing to define an outlet for the towelling and an open position where it provides access into the casing through the open bottom to enable the leading edge of the paper towelling to be grasped should it have ended up within the casing.

DESCRIPTION OF THE PREFERRED EMBODIMENTS

Figure 1:
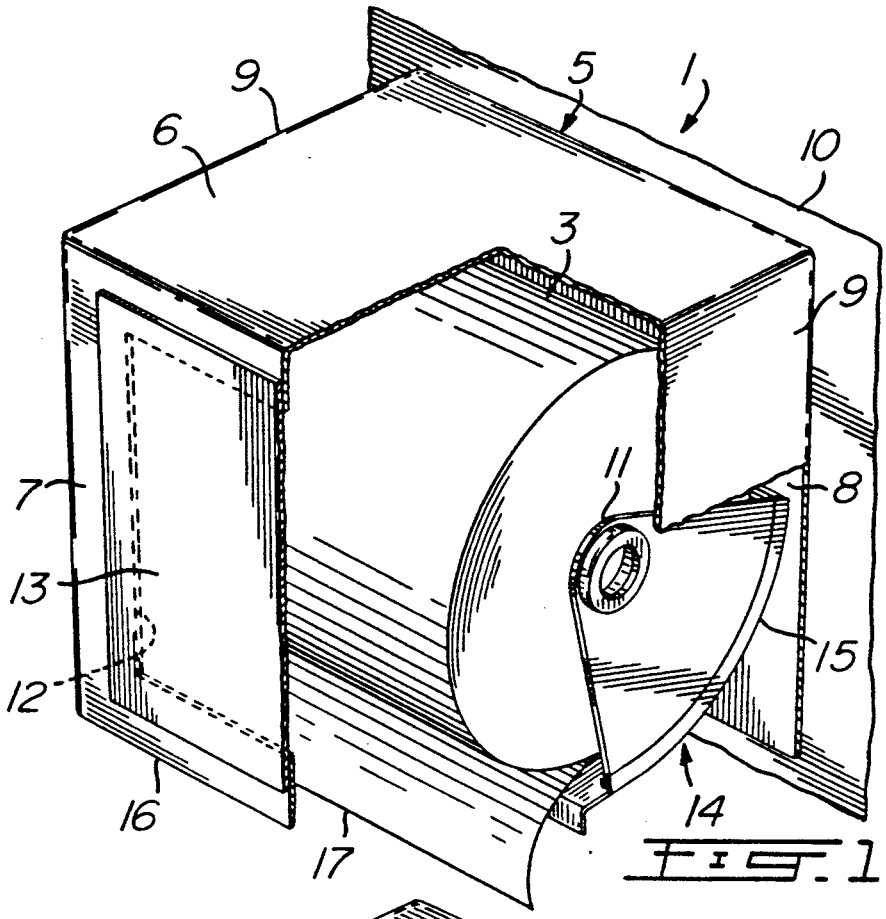
FIG. 1 is a partly cut away schematic view of the dispenser.

The invention as shown schematically in FIG. 1 is directed toward a paper towel dispenser 1 for use in dispensing paper towelling from a paper towel roll 3. The dispenser 1 has a casing 5 for holding the roll 3. The casing 5 has a top 6, front 7, back 8 and sides 9. The bottom of the casing 5 is open. The casing 5 is adapted to be mounted on a vertical surface such as a wall 10, with its back 8 against the wall 10, by suitable means (not shown).

The roll 3 of paper towelling is rotatably mounted within the casing 5 between the sides 9 of the casing. The axis of the core 11 of the roll 3 is parallel with the top 6 of the casing, the top 6 being horizontal when the casing 5 is mounted on a wall 10. The roll 3 can be mounted in various ways within the casing 5. A preferred way of mounting the roll 3 will be described below.

The casing 5 has a front opening 12 in the front 7 providing access into the casing. The roll 3 is mounted within the casing through this opening 12, and the empty core 11 is removed through the opening. The front opening 12 is normally closed by a cover 13 forming part of the casing 5.

The open bottom 14 of the casing 5 is normally closed with a bottom member 15 that is mounted on the casing. The bottom member 15 is movable between a closed position where it substantially closes the open bottom 14, and together with the front 7 of the casing 5 defines an outlet 16 for the towelling 17, and an open position where it allows access into the casing through the open bottom to enable the leading edge of the towelling to be grasped should it end up in the casing.

Figure 2:
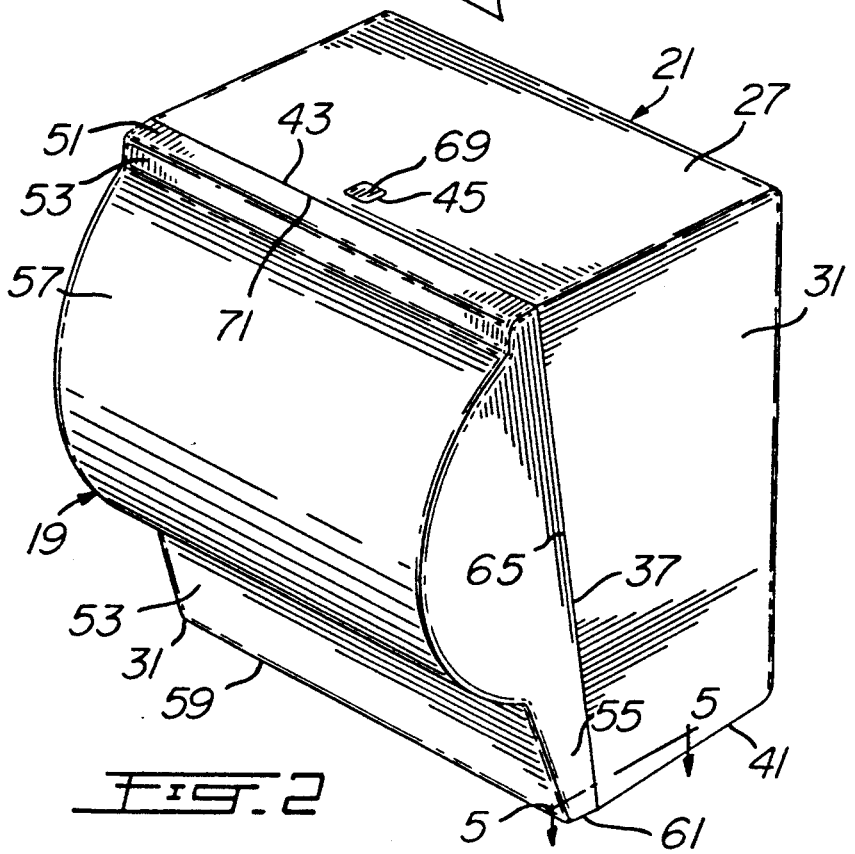
FIG. 2 is a perspective view of the assembled casing.
Figures 3, 4, 6:
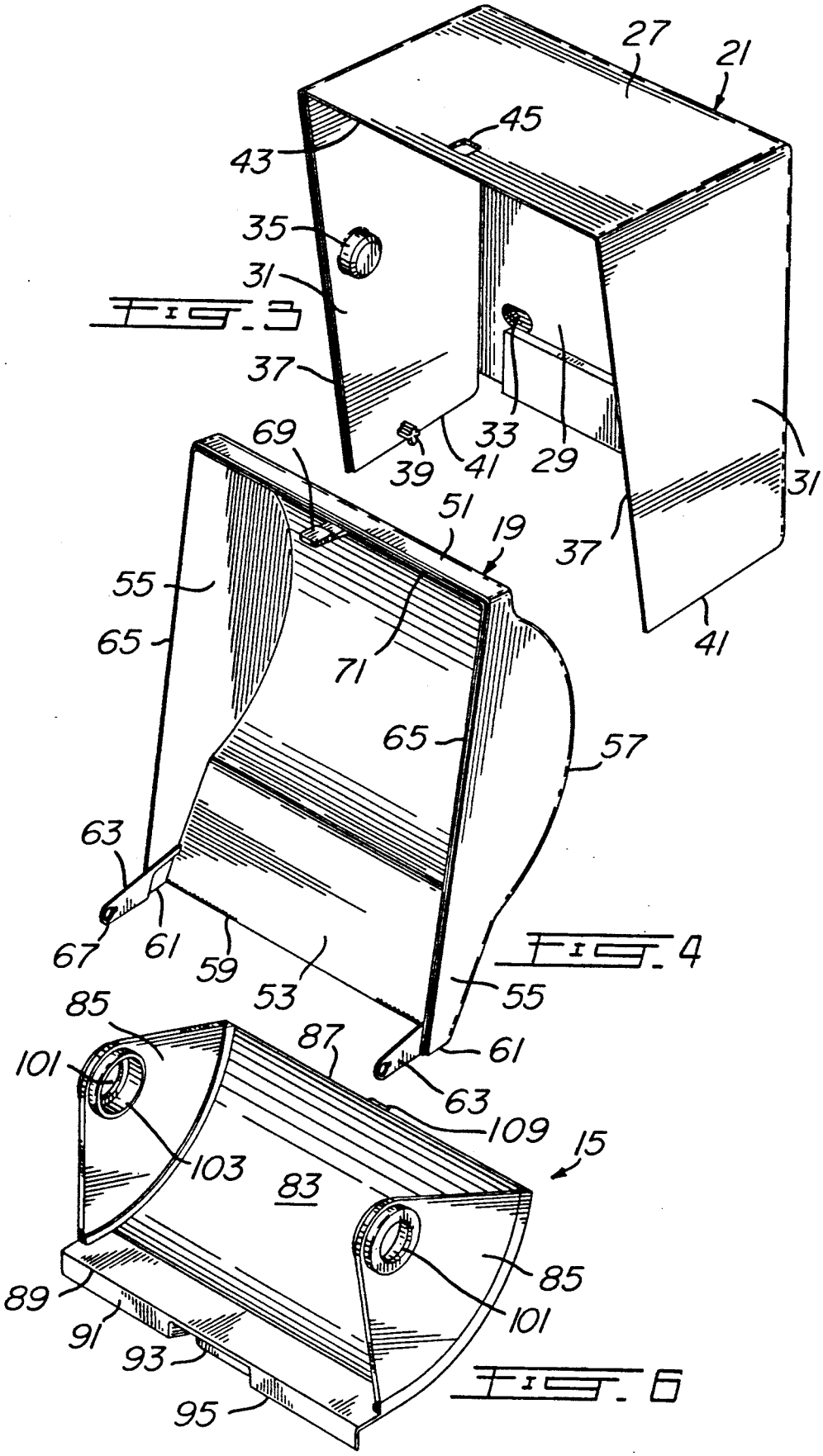
FIG. 3 is a front perspective view of the base of the casing.
FIG. 4 is a back perspective view of the cover of the casing.
FIG. 6 is a front perspective view of the bottom member.

In more detail, the casing 5 is made in two parts, a base 21 and the cover 19 as shown in FIG. 2. The base 21 as shown in FIG. 3 has a top wall 27, back wall 29, and parallel side walls 31 forming the top 6, back 8 and sides 9 of the casing 5. Openings 33 can be provided in the back wall 29 for use in attaching the base 21 to a wall 10. A stub axle 35 is provided on each side wall 31, projecting inwardly toward each other and located slightly above the center of the side walls 31. The stub axles 35 are also located close to the front edge 37 of the side walls 31. A pivot pin 39 is also provided on each side wall 31, projecting inwardly toward each other, and located just above the bottom edge 41 of the side wall 31. The pivot pins 39 are also located about one third of the width of the side wall 31, at its bottom edge 41, from the front edge 37 of the side wall 31. The front of the base 21 is open, the front edges 37 of the side walls 31 and the front edge 43 of the top wall 27 defining the front opening 12 of the casing 5. A latch opening 45 is provided in the top wall 27, close to its front edge 43, and midway between the side walls 31. The base 21 can be moulded in one piece from suitable plastic material.

Figure 5:
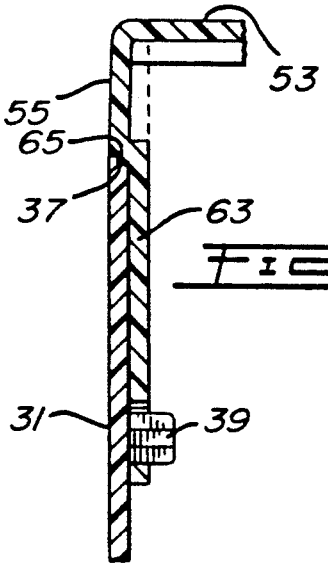
FIG. 5 is a detail cross-section view taken along line 5—5 in FIG. 2.

The cover 19, as shown in FIG. 4, has a top wall 51, a front wall 53 and side walls 55 and forms the front 7 of the casing 5, normally closing the front opening 12. The front wall 53 has an outwardly bowed portion 57 to accommodate a portion of the paper roll 3 mounted within the casing. The bottom edge 59 of the front wall 53 is slightly above the bottom edges 61 of the side walls 55 and is serrated at least at the ends to form a cutting edge for the paper towelling. A mounting arm 63 extends rearwardly from the lower back edge 65 of each side wall 55. These extended arms 63 also assist in preventing the cover 19 from hitting the wall 10 when the cover 19 is opened. Each mounting arm 63 is offset inwardly slightly from the side wall 55 as shown in FIG. 5 and has a mounting hole 67 at its end. A resilient latch 69 projects rearwardly past the back edge 71 of the top wall 51. The latch 69 is in the center of the top wall 51. The cover 19 can also be moulded in one piece from suitable plastic material that is preferably transparent.

The cover 19 is mounted on the base 21 by mounting the arms 63 of the cover on the pivot pins 39 of the base via the mounting holes 67 as shown in part in FIG. 5. The cover 19 normally closes the front opening 12 with the back edges 65 of the cover side walls 55 and the back edge 71 of the cover top wall 51 abutting the front edges 37 of the base side walls 31 and the front edge 43 of the base top wall 27 respectively. The latch 69 on the cover 19 snaps into the latch opening 45 on the base 21 to normally lock the cover 19 in a closed position closing the front opening 12. Depressing the latch 69 allows the cover 19 to be swung open about pivot pins 39 allowing an empty paper roll core to be removed and a new paper roll to be loaded into the dispenser as will be described.

Figure 7:
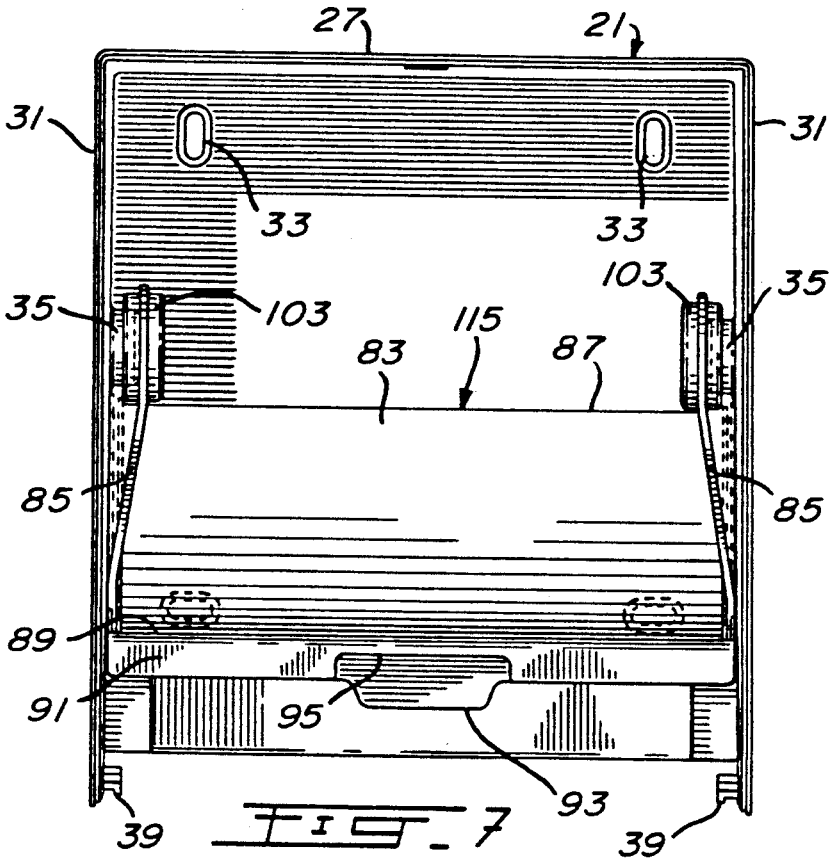
FIG. 7 is a front view of the base with the bottom member installed.

The bottom member 15 of the dispenser as shown in FIGS. 6 and 7 has a curved bottom wall 83 and side walls 85. The bottom wall 83 is curved through approximately ¼ of a circle and has a back, top edge 87 and a lower, front edge 89. A short front wall 91 extends down from the lower front edge 89 of the bottom wall 83. A push tab 93 is indented rearwardly from the front wall 91. The push tab 93 is centrally located and extends slightly below the bottom edge 95 of the front wall 91. The side walls 85 each have the general shape of a circular segment and extend from the top edge 87 to a position close to the front edge 89 of the bottom wall 83. Each side wall 85 has a bearing opening 101 at its outer end. The center of the opening 101 coincides with the center of curvature of the bottom wall 83. Each side wall 85 also has a core receiving ring 103 on its inner surface. The ring 103 is concentric about the bearing opening 101. The bottom member 15 can be moulded from suitable plastic material.

Figure 9:
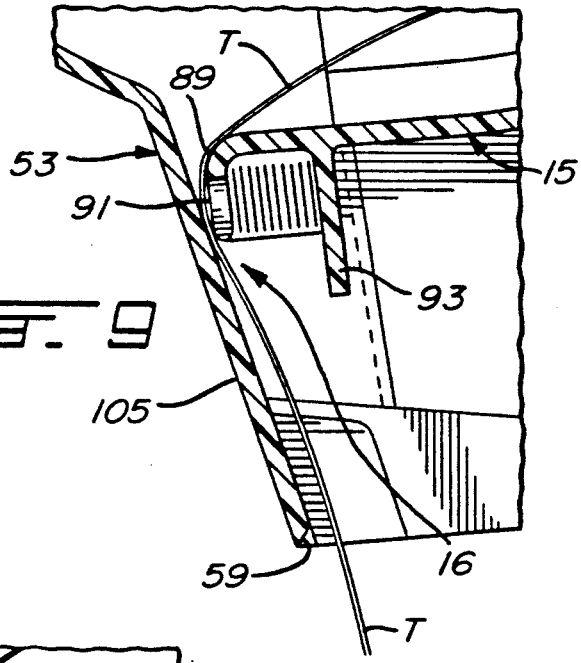
FIG. 9 is a detail, cross-sectional view of the outlet opening of the dispenser.
Figure 8:
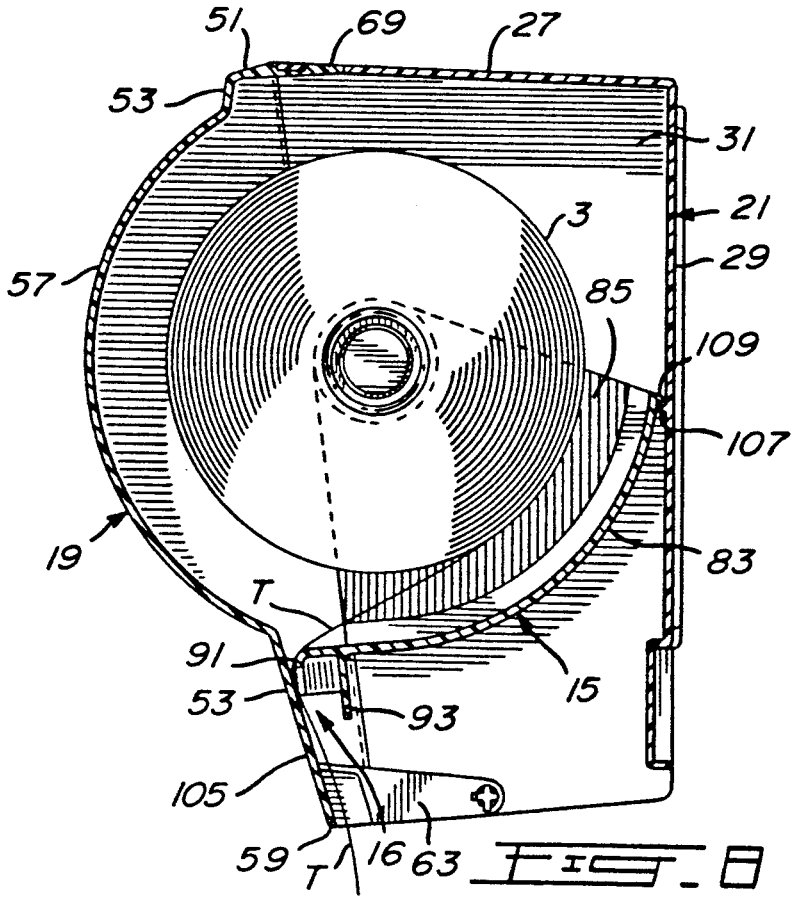
FIG. 8 is a transverse cross-section view of the dispenser with the bottom member closed.

The bottom member 15 is connected to the casing 5 by suspending it from the stub axles 35 on the side walls 31 of the base 21 as shown in FIG. 7. The side walls 85 of the bottom member 15 are resilient enough that they can be moved together enough to locate the axles 35 within the bearing openings 101 of the bottom member 15. The bottom member 15 normally hangs down from the stub axles 35 beneath a roll of towelling, with its front wall 91 close to the bottom portion 105 of the front wall 53 of the cover 13 substantially closing the open bottom of the casing 5 as shown in FIGS. 8 and 9. A stop 107 is provided in the back wall 29 of the casing 21 which cooperates with a lip 109 on the upper back edge 87 of the bottom member 15 to limit the downward and forward movement of the bottom member 15 under its own weight about the stub axles 35. The stop 107 serves to locate the front wall 91 of the bottom member 15 a short distance from the bottom portion 105 of the front wall 53 of the cover 19 to define a narrow slot-type outlet opening 16 for the towelling "T" as shown in FIG. 9. In addition the stop 107 prevents the bottom member 15 from swinging forward when the cover 19 is opened.

With the cover 19 unlatched and pivoted open, the paper towel roll 3 is rotatably mounted between the side walls 85 of the bottom member 15. The ends of the core 11 of the roll 3 fit into the core receiving rings 103 on the side walls 85. The side walls 85 can be resiliently moved apart on the axles 35 to allow mounting of the core ends in the rings 103. With the roll 3 in place, and the cover 19 closed, the towelling "T" is drawn off the roll 3 and down to extend between the front wall 91 of the bottom member 15 and the front wall 53 of the cover 19 defining slot outlet 16 and below the bottom serrated edge 59 of the cover as shown in FIG. 9. The serrations can extend along the whole length of the edge 59 but preferably extend only for about one quarter the length at each end of the edge 59.

In use, a length of the towelling is drawn off the roll 3 and torn off by pulling it against the serrated edge 59. The next user grasps the short bit of towelling located behind the bottom portion 105 of the front wall 53 of the cover 13 above the serrated edge 59, below the bottom edge 95 of the front wall 91 of the bottom member 15 and pulls off another length of towelling.

Figure 10:
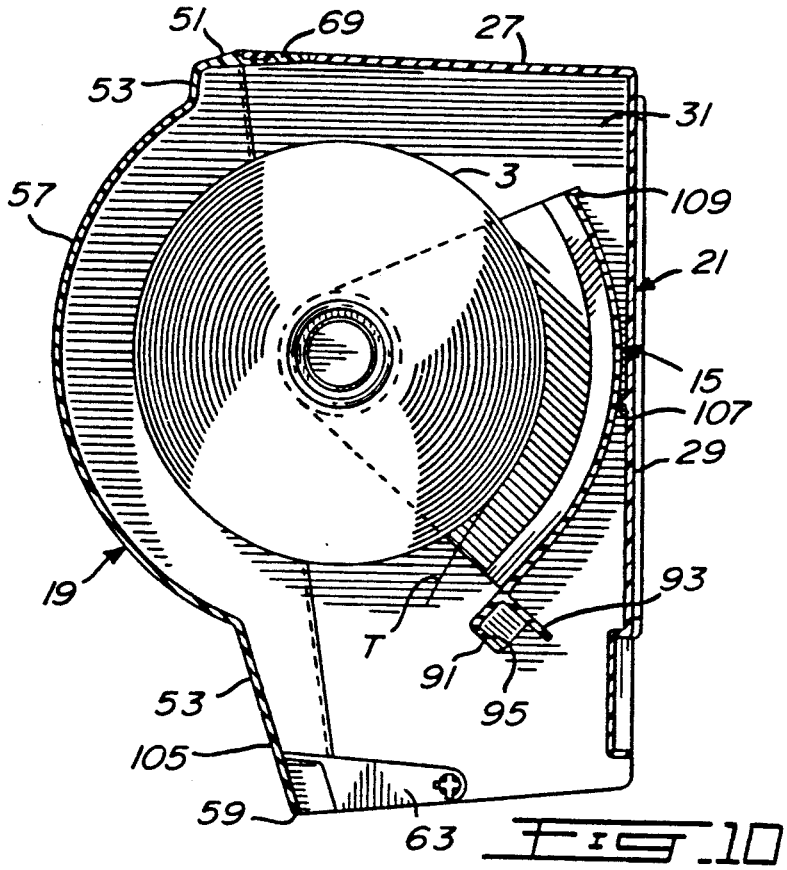
FIG. 10 is a view similar to FIG. 8 with the bottom member open.

If for some reason the towelling is torn in such a manner that its free edge ends up inside the casing above the front wall 91 of the bottom member 15, it is a simple matter for the user to pivot the bottom member 15. As shown in FIG. 10, this is done by pushing on its push tab 93, to push the bottom member 15 around the back of the towelling roll 3 thereby opening up the bottom of the casing and allowing the user to reach in with a free hand to grasp the free edge of the paper towelling and pull it down. Once the towelling is retrieved, the bottom member 15 is allowed to pivot back down under its own weight, closing the bottom of the casing. The stop 107, cooperating with the lip 109, limits the downward and forward movement of the bottom member 15.

Figure 12:
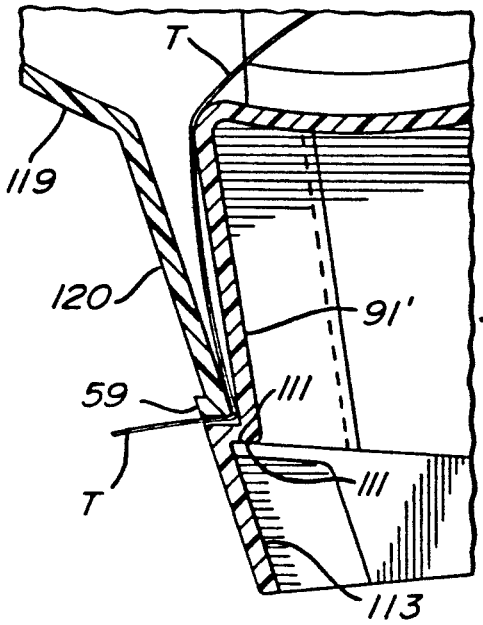
FIG. 12 is a detail, cross-sectional view of the outlet opening of the dispenser shown in FIG. 11.
Figure 11:
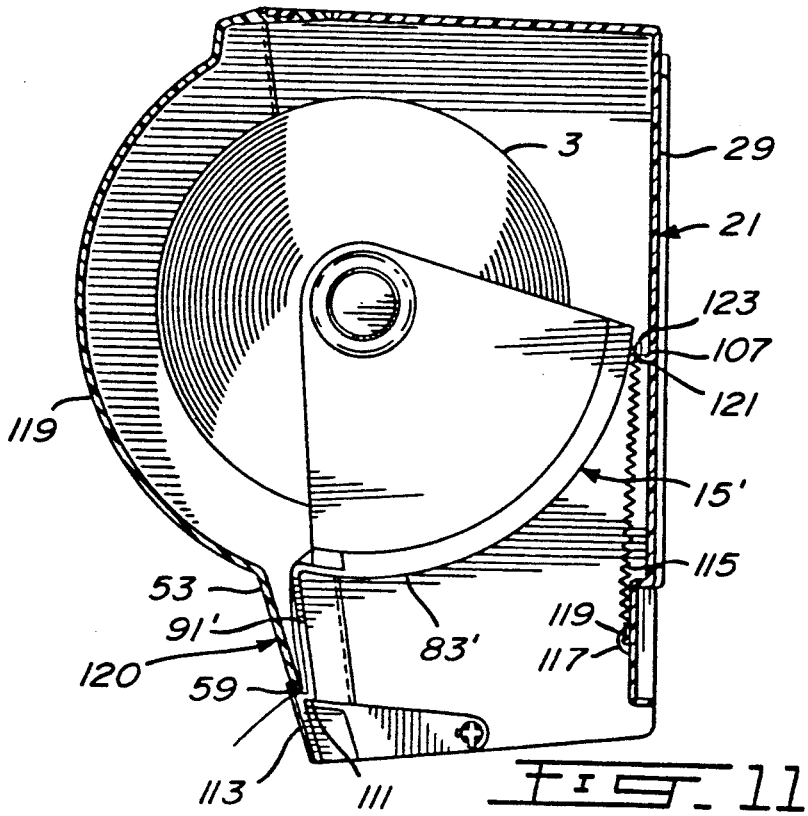
FIG. 11 is a view similar to FIG. 8 of another embodiment of the invention.

In a preferred embodiment of the invention, as shown in FIGS. 11 and 12, the bottom member 15' can be provided with a longer front wall 91' and with a step 111 therein for receiving the raised bottom edge 59 of the cover 119. The front wall 91' extends below the bottom edge 59 of the cover 119 and the step 111 provides a slightly tortuous path for the towelling "T" helping to hold it in place. If however the leading edge of the towelling ends within the casing above the front wall of the bottom member, the bottom member 15' can be pivoted to open up the bottom of the casing by pushing against the bottom portion 113 of the front wall 91' of the bottom member 15'.

Resilient means can be provided to ensure return of the bottom member 15' to its closed position and to hold it snugly against the cover 119 thus helping maintain the towelling "T" in position as shown in FIG. 12. The resilient means can comprise a tension spring 115 as shown in FIG. 11 mounted to its lower end 117 to a hook 119 on the lower portion of the back wall 29 of the base 21 and mounted at its upper end 121 to a hook 123 on the upper portion of the bottom wall 83' of the bottom member 15'. The spring 115 is stretched and tensioned when the bottom member 15' is pivoted to an open position and helps return the bottom member to its closed position. The spring 115 not only returns the bottom member 15' to its closed position but also holds it there with the front wall 91' of the bottom member 15' snug against the bottom portion 120 of the front wall 53 of the cover 119 to clamp the towelling "T" in place. The spring also minimizes paper waste. One hand is required to hold the bottom member 15' open. Thus only one hand can be used to draw out paper. Normally only that amount of paper is drawn out with the one hand that can be accommodated with arm movement. Without the spring, a person could employ two hands to draw out the paper, one hand working over the other, and thus more paper could be drawn out than is needed. The spring 115 does not prevent a person from drawing out paper hand over hand, but does discourage it.

While one configuration of a casing 5 has been described in detail, the casing 5 can have other configurations. For example, the cover could comprise the front and entire top of the casing while the back would only have the sides and back of the casing. In another configuration, the base could include the top, back and sides of the casing along with a portion of its front.

The one configuration of the casing 5 also shows the pivot axis of the bottom member 15 coinciding with the axis of rotation of the roll. However the pivot axis of the bottom member can be at a different location in the casing from the axis of rotation of the roll.

I claim:

1. A paper towel dispenser having:

a casing with a top, front, back and sides for enclosing and rotatably supporting a roll of paper towelling between the sides of the casing;

the casing having a bottom opening providing access into the casing, said bottom opening defined by the front of the casing and a rearward portion of said casing;

and a bottom member pivotably mounted on the sides of the casing, the bottom member movable between a closed position where the bottom member hangs down and extends between the front and said rearward portion of said casing to substantially close the bottom opening of the casing, and an open position where the bottom member has been moved up and back into the casing to provide access into the casing through the bottom opening to enable a leading edge of paper towelling to be grasped should the leading edge having ended up within the casing; and an outlet for the towelling defined by the bottom member, in the closed position, together with the front of the casing.

2. A paper towel dispenser as claimed in claim 1 wherein the bottom member has a front wall that is adjacent the front of the casing when the bottom member is in the closed position;

and wherein said outlet for the towelling is defined by the front wall of the bottom member together with a bottom portion of the front of the casing.

3. A paper towel dispenser as claimed in claim 2 including cooperating means on the bottom member and the casing for locating the front wall of the bottom member a short distance from the bottom portion of the front of the casing to define the outlet for the paper towelling as a slot.

4. A paper towel dispenser as claimed in claim 3 wherein the front of the casing has a bottom edge which is serrated to help tear dispensed paper towelling.

5. A paper towel dispenser as claimed in claim 2 including resilient means biasing the bottom member to the closed position.

6. A paper towel dispenser as claimed in claim 5 wherein the resilient means biases the front wall of the bottom member against the bottom portion of the front of the casing to clamp the paper towelling between the front wall and the bottom portion in the outlet.

7. A paper towel dispenser as claimed in claim 1 including a front opening in the front of the casing that is normally closed, the front opening allowing loading of the paper roll into the casing when the front opening is open.

8. A paper towel dispenser having:

a casing; the casing having a base, a cover and an open bottom;

the base having a back wall, a top wall, side walls and an open front; the cover having a front wall and hinged to the side walls of the base;

the cover movable between a closed position closing the front of the base and an open position allowing access into the base through the front;

a bottom member;

means for pivotably mounting the bottom member on the side walls of the base; the bottom member movable between a closed position where the bottom member hangs down and extends between the back wall of the base and the front wall of the cover and substantially closes the open bottom of the casing, and an open position where the bottom member has been moved up and back into the casing and lies adjacent to the back wall of the base to provide access into the casing through the open bottom to enable a leading edge of a roll of paper towelling mounted in the dispenser to be grasped should the leading edge have ended up within the casing.

9. A paper towel dispenser as claimed in claim 8 wherein the bottom member has a front wall that is adjacent the front wall of the cover when the bottom member and cover are in their closed positions, the front wall of the bottom member together with a bottom portion of the front wall of the cover defining an outlet for the paper towelling.

10. A paper towel dispenser as claimed in claim 9 including cooperating means on the bottom member and the base for locating the front wall of the bottom member a short distance from the bottom portion of the front wall of the cover to define the outlet for the paper towelling as a slot.

11. A paper towel dispenser as claimed in claim 10 wherein the front wall of the cover has a bottom edge which is serrated to help tear the paper towelling.

12. A paper towel dispenser as claimed in claim 9 including resilient means connected between the bottom member and the back wall of the base to bias the bottom member to its closed position.

13. A paper towel dispenser as claimed in claim 12 wherein the resilient means biases the front wall of the bottom member against the bottom portion of the front wall of the cover to clamp the paper towelling between the front wall of the bottom member and the bottom portion in the outlet.

* * * * *